US005192244A

United States Patent [19]

Rose

[11] Patent Number: 5,192,244

[45] Date of Patent: Mar. 9, 1993

[54] AIR VENT STOPPER

[76] Inventor: Kenneth A. Rose, 689 Coleman Ave., Holly Springs, Miss. 38635

[21] Appl. No.: 833,946

[22] Filed: Feb. 11, 1992

[51] Int. Cl.[5] ..... F24F 13/20

[52] U.S. Cl. ..... 454/276; 49/463

[58] Field of Search ..... 454/270, 271, 275, 276, 454/277; 49/463

[56] References Cited

U.S. PATENT DOCUMENTS

| | | | |
|---|---|---|---|
| 978,718 | 12/1910 | Ellington | 454/275 X |
| 1,798,350 | 3/1931 | Parizek | 454/275 |
| 2,821,895 | 2/1958 | Allabaugh | 454/276 |
| 2,843,035 | 7/1958 | Jacks | 454/276 |
| 3,130,659 | 4/1964 | Compton et al. | 454/276 |
| 4,026,082 | 5/1977 | Crofoot | 454/276 X |

*Primary Examiner*—Harold Joyce

*Attorney, Agent, or Firm*—Richard L. Miller

[57] ABSTRACT

An air vent stopper is provided for a ventilation grill having a plurality of ribs mounted within an opening in a building wall. The air vent stopper consists of a plate being of a size and shape to completely cover over the ribs in the ventilation grill. A gasket being of a same size and shape as the plate is positioned between the plate and the ventilation grill. Clip-on U-shaped clamp is for removably securing the plate with the gasket to some of the ribs of the ventilation grill, so as to completely seal the ventilation grill from leaking air therethrough during cold weather conditions.

3 Claims, 1 Drawing Sheet

AIR VENT STOPPER

BACKGROUND OF THE INVENTION

The instant invention relates generally to covers for air vents and more specifically it relates to an air vent stopper.

Numerous covers for air vents have been provided in the prior art that are adapted to be secured directly to the frame of the air vents or to the walls about the air vents. For example, U.S. Pat. No. Des. 244,539 to Mulligan; U.S. Pat. No. Des. 245,255 to Porter and U.S. Pat. No. 4,502,368 to Hempel all are illustrative of such prior art. While these units may be suitable for the particular purpose to which they address, they would not be as suitable for the purpose of the present invention as hereafter described.

SUMMARY OF THE INVENTION

A primary object of the present invention is to provide an air vent stopper that will overcome the shortcomings of the prior art devices.

Another object is to provide an air vent stopper which can be quickly assembled and disassembled to a front face of a ventilation grill that is old or contains a damaged shutoff mechanism, so as to completely seal the ventilation grill during cold weather conditions.

An additional object is to provide an air vent stopper that includes a plate and gasket of a size larger than the openings in the ventilation grill, which can be simply secured to the ventilation grill by clip-on fasteners which extend through the plate and gasket into the ventilation grill.

A further object is to provide an air vent stopper that is simple and easy to use.

A still further object is to provide an air vent stopper that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
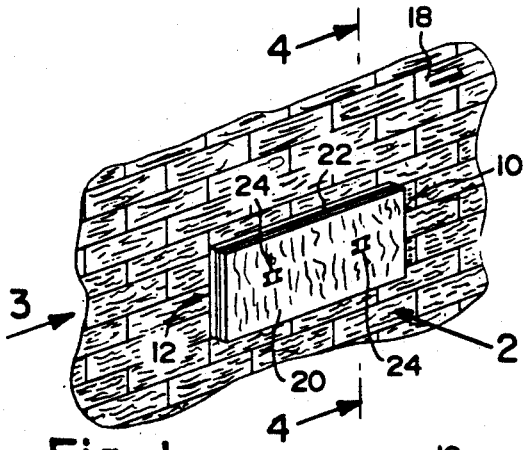
FIG. 1 is a diagrammatic perspective view illustrating the instant invention in use covering over a ventilation grill.
Figure 2:
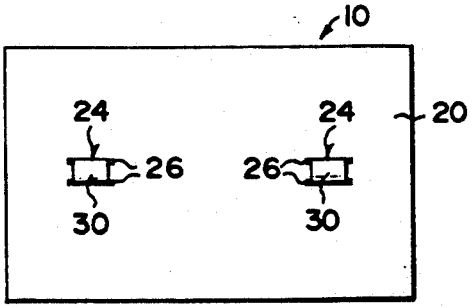
FIG. 2 is an enlarged front elevational view taken in the direction of arrow 2 in FIG. 1 of just the instant invention per se.
Figure 4:
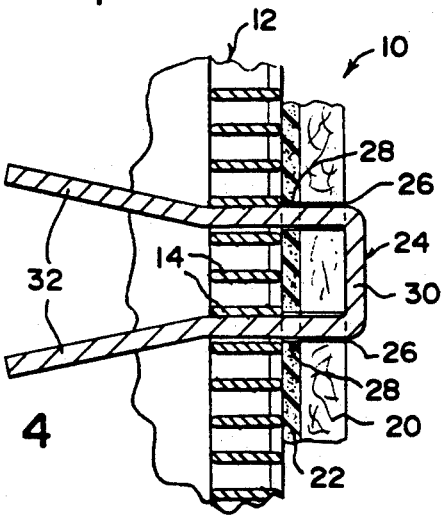
FIG. 4 is a still further enlarged cross sectional view with parts broken away taken on line 4—4 in FIG. 1.
Figure 3:
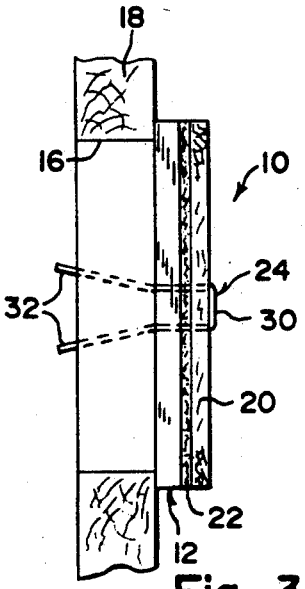
FIG. 3 is an enlarged diagrammatic side view partially in section taken in the direction of arrow 3 in FIG. 1.
Figure 5:
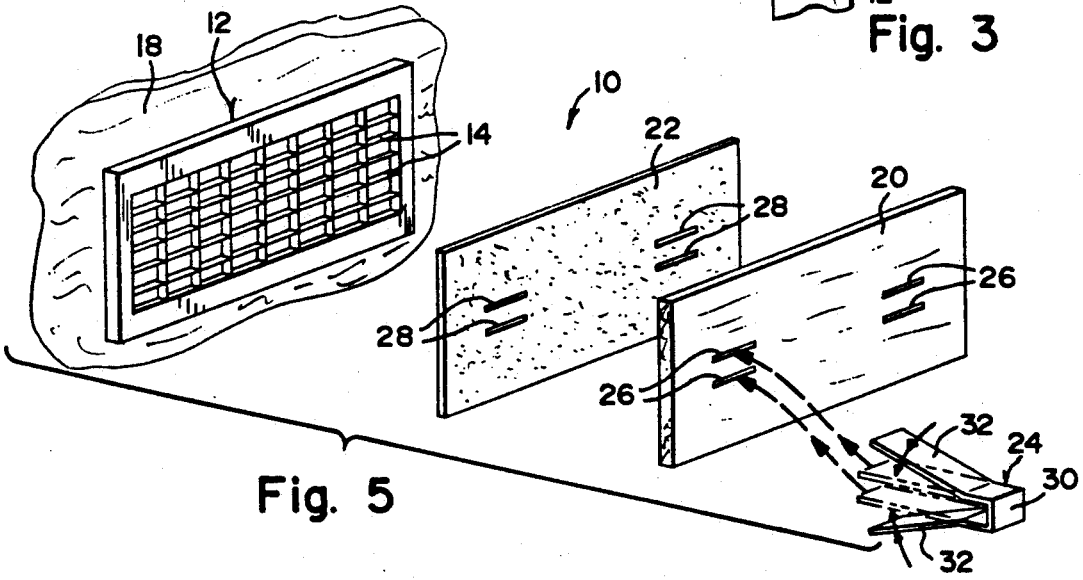
FIG. 5 is a diagrammatic exploded view illustrating the cooperation between the various components of the instant invention.

Turning now descriptively to the drawings, in which similar reference characters denote similar elements throughout the several views, the Figures illustrate an air vent stopper 10 for a ventilation grill 12 having a plurality of ribs 14 mounted within an opening 16 in a building wall 18. The air vent stopper 10 consists of a plate 20 being of a size and shape to completely cover over the ribs 14 in the ventilation grill 12. A gasket 22 being of a same size and shape as the plate 20 is positioned between the plate 20 and the ventilation grill 12. A structure 24 is for removably securing the plate 20 with the gasket 22 to some of the ribs 14 of the ventilation grill 12, so as to completely seal the ventilation grill 12 from leaking air therethrough during cold weather conditions.

The removably securing structure 24 includes the plate 20 having two sets of two spaced apart slots 26 therethrough. The gasket 22 having two sets of two spaced apart slots 28 therethrough aligned with the two sets of two spaced apart slots 26 in the plate 20. Two clip-on U-shaped clamps 30 are provided with each having two outwardly extending flared flexible fingers 32. When the fingers 32 are squeezed together they can be pushed through two spaced apart slots 26 in the plate 20, two spaced apart slots 28 in the gasket 22 and past through the ribs 14 in the ventilation grill 12. The two outwardly extending flared flexible fingers 32 will spread apart when released to retain the plate 20 with the gasket 22 thereto.

The plate 20 is rectangular and is made out of a durable sturdy material, such as wood or plastic. The gasket 22 is rectangular and is made out of a durable compressible material, such as foam rubber or rubber.

To install the air vent stopper 10 the following steps should be followed:

1. Place the gasket 22 against the back of the plate 20.
2. Make sure that the slots 26 in the plate 20 align with the slots 28 in the gasket 22.
3. Adhesive can be utilized to permanently adhere the gasket 22 to the plate 20.
4. Place the gasket 22 and the plate 20 against the ribs 14 of the ventilation grill 12, so that the ventilation grill 12 is completely covered.
5. Insert the clip-on U-shaped clamps 30 through the slots 26 and 28 respectively and past the ribs 14, so that the vent stopper 10 will be retained in place to prevent air leakage.

While certain novel features of this invention have been shown and described and are pointed out in the annexed claims, it will be understood that various omissions, substitutions and changes in the forms and details of the device illustrated and in its operation can be made by those in the art without departing from the spirit of the invention.

What is claimed is:

1. An air vent stopper for a ventilation grill having a plurality of ribs mounted within an opening in a building wall, said air vent stopper comprising:

a) a plate being of a size and shape to completely cover over the ribs in the ventilation grill;

b) a gasket being of a same size and shape as said plate for and positioning between said plate and the ventilation grill; and c) means for removably securing said plate with said gasket to some of the ribs of the ventilation grill, so as to completely seal the ventilation grill from leaking air therethrough during cold weather conditions, wherein said removably securing means includes:

i) said plate having at least two spaced apart slots therethrough;

ii) said gasket having at least two spaced apart slot therethrough aligned with the at least two spaced apart slots in said plate; and iii) at least one clip-on fastener being a U-shaped having two outwardly extending flared flexible fingers which when squeezed together can be pushed through the at least two spaced apart slots in said plate, the at least two spaced apart slots in said gasket and past through the ribs in the ventilation grill, whereby said two outwardly extending flared flexible fingers will spread apart when released to retain said plate with said gasket thereto.

2. An air vent stopper for a ventilation grill as recited in claim 1, wherein said plate is rectangular and is made out of a durable sturdy wood.

3. An air vent stopper for a ventilation grill as recited in claim 2, wherein said gasket is rectangular and is made out of a durable compressible foam rubber.

* * * * *